US010086409B2

(12) United States Patent
Heitfeld

(10) Patent No.: US 10,086,409 B2
(45) Date of Patent: Oct. 2, 2018

(54) SCREEN TENSIONING SYSTEM AND METHOD

(71) Applicant: M-I L.L.C., Houston, TX (US)

(72) Inventor: Mark Heitfeld, Cleves, OH (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 14/892,720

(22) PCT Filed: Jun. 3, 2015

(86) PCT No.: PCT/US2015/033942
§ 371 (c)(1),
(2) Date: Nov. 20, 2015

(87) PCT Pub. No.: WO2016/195673
PCT Pub. Date: Dec. 8, 2016

(65) Prior Publication Data

US 2017/0100747 A1 Apr. 13, 2017

(51) Int. Cl.
*B07B 1/49* (2006.01)
*B07B 1/48* (2006.01)

(52) U.S. Cl.
CPC ..... *B07B 1/48* (2013.01)

(58) Field of Classification Search
CPC ..... B07B 1/48; B07B 1/485; B07B 1/49
USPC ..... 209/403, 405
See application file for complete search history.

(56) References Cited

U.S. PATENT DOCUMENTS

| | | | | |
|---|---|---|---|---|
| 3,092,573 | A * | 6/1963 | Lambert | B07B 1/48 209/319 |
| 3,557,953 | A * | 1/1971 | Hubach | B07B 1/49 101/127.1 |
| 3,870,630 | A * | 3/1975 | Tylinski | B07B 1/48 209/403 |
| 4,148,724 | A * | 4/1979 | Hannon | B07B 1/62 209/403 |
| 5,332,101 | A * | 7/1994 | Bakula | B07B 1/48 160/328 |
| 6,659,286 | B2 * | 12/2003 | Seyffert | B01D 33/0376 209/405 |
| 7,228,971 | B2 * | 6/2007 | Mooney | B07B 1/48 209/397 |
| 7,478,728 | B2 * | 1/2009 | Fisher | B07B 1/485 209/319 |
| 7,918,346 | B2 * | 4/2011 | Roppo | B07B 1/485 209/405 |
| 7,942,272 | B2 * | 5/2011 | Fisher | B07B 1/46 209/399 |
| 2006/0260987 | A1 * | 11/2006 | DeCenso | B07B 1/46 209/235 |

* cited by examiner

*Primary Examiner* — Terrell H Matthews
(74) *Attorney, Agent, or Firm* — Paula B. Whitten

(57) ABSTRACT

A system and a method tension a screen having a generally rectangular shape defined by a length and a width. The screen has a profile with a shape extending the length of the screen. A rod has a channel configured to receive the shape of the profile of the screen therein. The rod has a plurality of segmented portions such that a first segmented portion of the plurality of segmented portions is separable from a second segmented portion of the plurality of segmented portions. The screen is positioned on a frame. The rod is positioned parallel to the length of the frame on two sides. A clamping mechanism tensions the screen with respect to the frame.

20 Claims, 7 Drawing Sheets

SCREEN TENSIONING SYSTEM AND METHOD

BACKGROUND

In certain industries and/or applications, separating one material from a second material is often desired and/or required. Further, the separation of solids and fluids is generally known in a variety of industries and/or applications. For example, industrial separators use screens to separate solids and/or fluids as desired. Also, the mining industry has many applications in which solids may be separated from fluids to extract a desired ore and/or metal during mining processes. Further, on-shore and/or off-shore drilling applications use various methods and/or equipment to separate solids from fluids in drilling processes.

Conventional vibratory screen apparatus for sifting material generally utilize screens of either hook strip or pretensioned design. Hook strip screens generally have a single layer or multiple layers of mesh bonded together. The screens may be tensioned after the screens have been mounted in the basket of the vibratory screen apparatus. Two opposed ends of the screen are fitted with a turn back element to form a hook strip. The hook strip may be hooked around a tension rail which may be attached to the side wall of the basket. Typically, a tension bolt may be used. However, other loading means to apply tensioning and securing forces may be employed. Tightening the tension bolt may move the tension rail outwardly towards the walls of the basket to apply tension to the screen.

Hook strip screens may be pretensioned prior to mounting in the basket by attachment of the screen mesh element to an apertured support plate, typically by means of an adhesive. A screen having a plurality of mesh layers may be pretensioned. In some designs, layers of fused mesh may be corrugated prior to mounting to an apertured support plate and the hooks applied thereafter to the mesh-plate combination.

Hook strip screens have a number of disadvantages including the complex and time consuming mounting of the screen members in the basket which results in significant downtime of the vibratory screen apparatus and requires the use of multiple parts. Attaining the correct screen tension for the sieved material also involves intricate fine tuning. The screens may be easily damaged if too much force is applied when tightening the bolts or loading means to tension the screens. A further disadvantage is the relatively poor sealing between the screen and basket. The metal on metal seal often results in leakage. Unscreened material may pass through gaps between the screen and the basket and may mix with already screened material below the mesh screen. Attempts to overcome the poor seal by placing rubber strips and/or gaskets at the metal/metal interfaces require intricate and time-consuming fitting. The strips and/or gaskets frequently work loose during vibration and become lost or lodged in the vibratory machine which obstructs and/or damages the machinery. In addition, applying tension to the screen when tightening the tension bolt adds undesirable stresses to the machine frame.

Pretensioned screens generally have one or more layers of mesh permanently bonded under tension onto a generally rigid steel and/or plastics material apertured plate support frame. The mesh screen may be flat or crowned. The screen and frame are inserted into the basket as a unit which requires no adjustment to the tension of the screen. The screen and frame are normally secured in the machine by clamps from above and/or below. The clamps may be hydraulic pistons, inflatable clamping bags, bolts, tapered elements and/or the like.

Conventional pretensioned screen units with integral support frames have significant disadvantages. For example, conventional pretensioned screens may be bulky, heavy and difficult to handle, transport and store. Typically, the design may be complex, and the frames may be expensive to construct. Plastic injection molding is commonly used which is an inflexible method of construction. The frames utilize large amounts of material which require disposal when the screen units are replaced. The disposal is inconvenient, expensive and negatively impacts the environment.

Over the life of the screen, the particles cause wear on the wire mesh. Damage causes a breach in the mesh. As a result, that area of the mesh allows larger particles to pass through than desired. After the damage occurs, the screen must be replaced or repaired.

Thus, many conventional screens may be large and cumbersome to handle during transportation, installation and/or removal. Manipulating the screens is difficult for a single user. The large screens may also be rigid which increases the difficulty in removing the screen from the separator. Also, the rigid screens are difficult to transport and/or store. In certain situations in which the available space surrounding the separator is limited, maneuvering the screens for installation and/or replacement is challenging.

DETAILED DESCRIPTION

The embodiments disclosed herein relate generally to a system and a method for filtering and/or separating materials. More specifically, embodiments disclosed herein relate to a system and a method for tensioning a screen.

Screens may be used to filter particles in industrial filtration systems. For example, such separators may use screens to separate solids from fluids. To promote separation, vibrational and/or circular motion may be applied to the screen.

Figure 1:
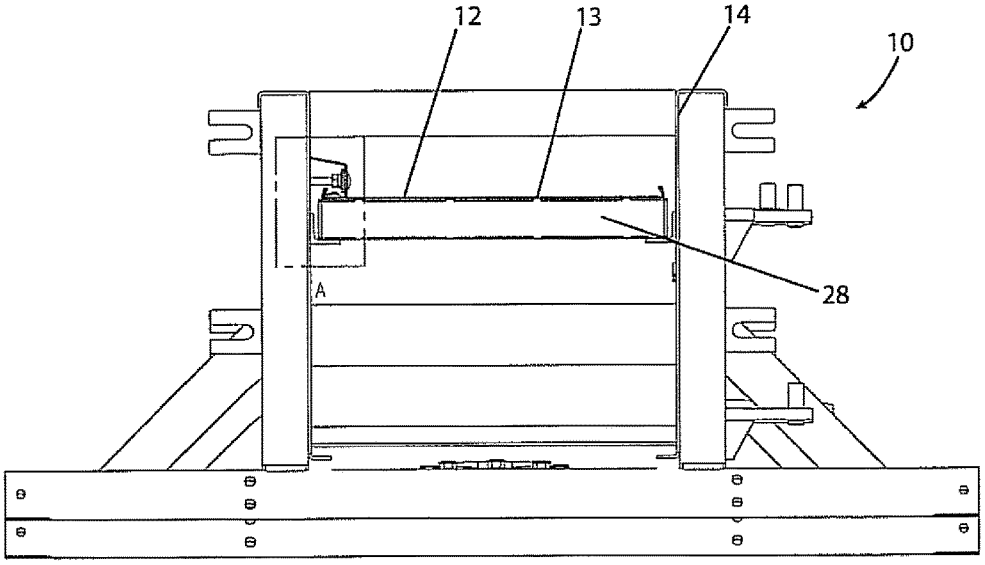
Prior Art FIG. 1
FIG. 1 illustrates a prior art vibratory screen apparatus having a screen with a hook strip.
Figure 2:
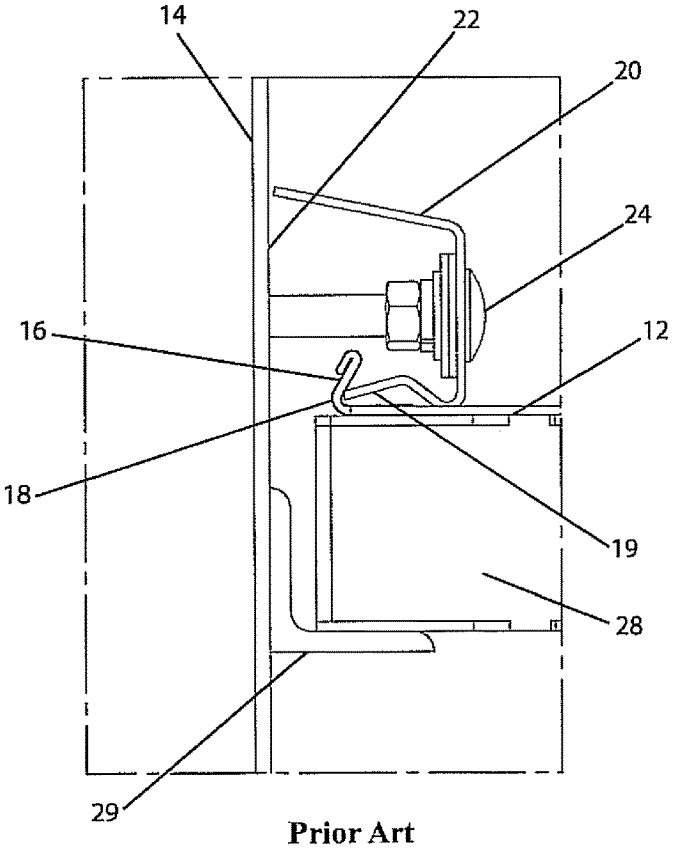
Prior Art FIG. 2
FIG. 2 illustrates a detail view of the prior art hook strip located within box "A" of FIG. 1.

FIG. 1 illustrates a vibratory screen apparatus, commonly referred to as a separator 10. The separator 10 shown in FIG. 1 has a hook strip screen 12. The connection of the hook strip screen 12 is also illustrated in greater detail in FIG. 2. Generally, the hook strip screen 12 may have a single layer of mesh 13. Multiple layers of mesh may also be bonded together. The mesh 13 may be tensioned after mounting the hook strip screen 12 in a basket 14 of the separator 10. Two opposed ends of the hook strip screen 12 may be fitted with a turn back element 16 to form a hook strip 18 which may be hooked around a retaining portion 19 of a tension rail 20. For simplicity, FIG. 1 illustrates a left side connection for the hook strip screen 12. However, the right side connection may be provided in the same manner. Further, a single deck is shown. However, the separator 10 may have multiple decks.

For example, the tension rail 20 may be attached to a side wall of the basket 14. The tension rail 20 may be attached via a tension bolt 24. Tightening the tension bolt 24 may move the tension rail 20 outwardly towards the interior walls 22 of the basket 14 of the separator 10 to apply tension to the hook strip screen 12. The retaining portion 19 of the tension rail 20 may press against the hook strip 18. The hook strip screen 12 may normally be stretched over a crowned deck (not shown). The resulting arcuate profile of the hook strip screen 12 may retain rigidity of the hook strip screen 12 during vibratory motion of the separator 10.

Typically, the hook strip screen 12 may be located above a ball box 28. The ball box 28 may be generally rectangular in shape. However, other shapes may be used. The ball box 28 may be held in the basket 14 of the separator 10 on a ball box rail 29. The ball box 28 may contain balls and/or other objects (not shown) of various shapes and/or sizes therein. The objects may move during vibratory motion produced during operation of the separator 10. The movement of the objects may cause impact with the hook strip screen 12 above the ball box 28 to impart movement of the solids on the hook strip screen 12. The ball box 28 may be supported by rails 30 attached to the interior walls 22 of the basket 14 of the separator 10.

Figure 3:
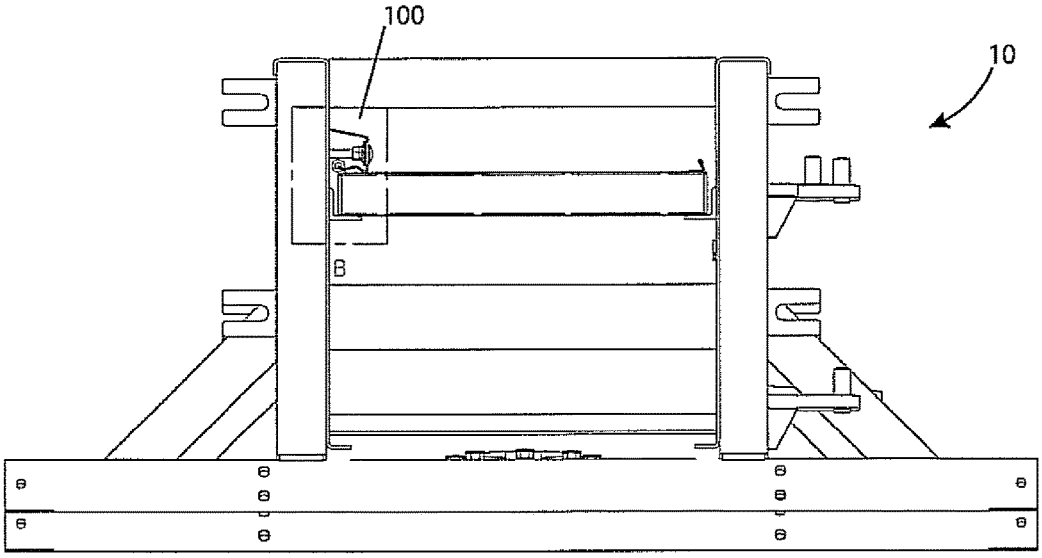
FIG. 3 illustrates an elevation view of a vibratory screen apparatus having a screen rod tensioning system in accordance with embodiments disclosed herein.
Figure 4:
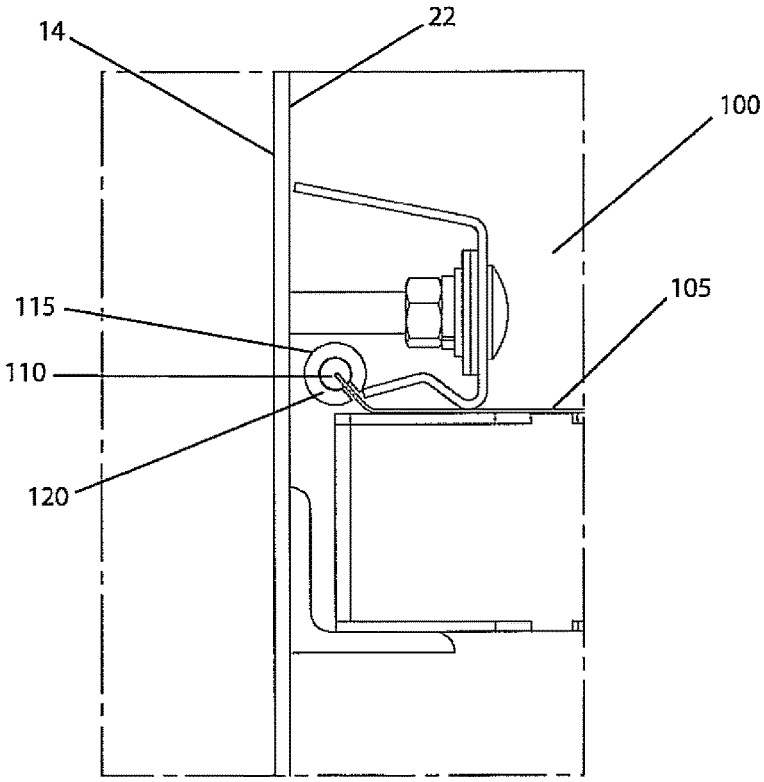
FIG. 4 illustrates a detail view of the screen rod tensioning system within box "B" of FIG. 3.

Referring to FIGS. 3 and 4, an embodiment of a screen rod tensioning system 100 is shown. For simplicity, FIGS. 3 and 4 illustrate a left side connection for the screen rod tensioning system 100. However, the right side connection may be provided in the same manner.

In an embodiment, the screen rod tensioning system 100 has a screen 105. The screen 105 may have a single layer of woven mesh wire or may be multiple layers of woven mesh wire. The screen 105 may be a mesh cloth. The screen 105 may have a mesh size to filter particles. For example, the screen 105 may have the mesh size to separate drill cuttings from circulated drill fluid. The mesh size as used herein refers to the size of the apertures in the screen 105.

Figure 12:
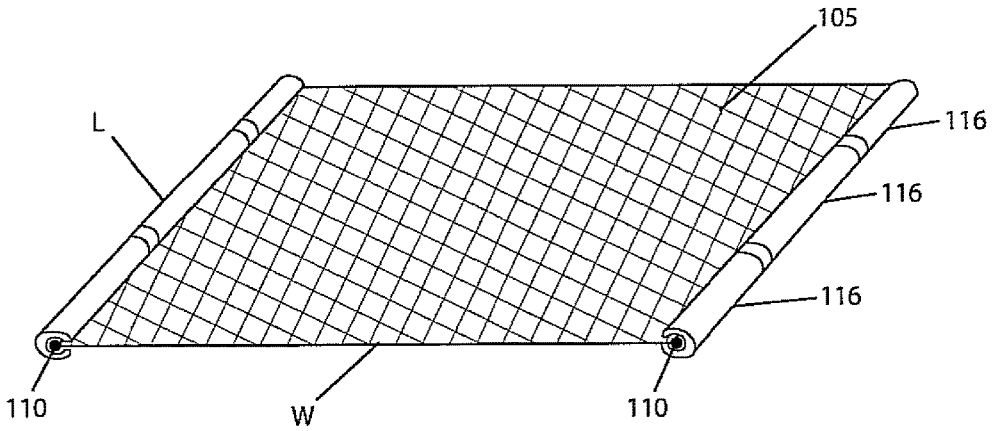
FIG. 12 illustrates a perspective view of a screen rod tensioning system in accordance with embodiments disclosed herein.
Figure 13:
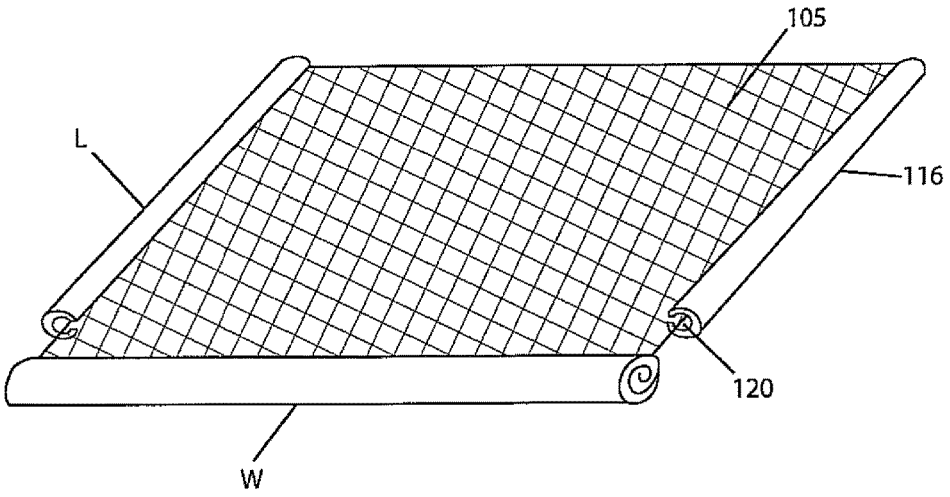
FIG. 13 illustrates a perspective view of a screen rod tensioning system in a rolled position in accordance with embodiments disclosed herein.

The screen 105 may have a length L and a width W as shown in FIGS. 12 and 13. The screen 105 may have a profile 110 molded on the edge of the screen 105. The profile 110 may be molded on opposing sides of the screen 105. The profile 110 may be molded lengthwise on the screen 105. The profile 110 may have a circular cross-section as shown. However, other shapes and/or cross-sections may be used, as desired. The profile 110 may be formed from a material that has sufficient rigidity to maintain the shape of the profile 110. However, the profile 110 may be made from a material that may permit rolling the screen 105 widthwise along the width W instead of lengthwise along the length L.

Thus, the screen rod tensioning system 100 may allow the screen 105 to be rolled widthwise instead of lengthwise. For example, a traditional five foot by twelve foot screen may require a twelve foot long tube for shipping and/or transport. The screen rod tensioning system 100 may allow the same size screen to be shipped in a five foot long tube. The reduction in size may improve the ease of handling the screen 105.

The screen rod tensioning system 100 may have a rod 115. The rod 115 may have a channel 120 to receive the profile 110 formed on the edge of the screen 105. For example, the channel 120 in the rod 115 may have a matching cross-section to accommodate the cross-section of the profile 110. As shown, the circular cross-section of the profile 110 may fit within the circular cross-section of the channel 120. The channel 120 may be sized slightly larger than the profile 110 so that the rod 115 may slide down the length L of the profile 110 of the screen 105 on both sides.

Thus, the profile 110 of the screen 105 may be inserted into the rod 115 in the screen rod tensioning system 100. As shown in FIGS. 3 and 4, the rod 115 may be held in place by the retaining portion 19 of the tension rail 20. Tightening the tension bolt 24 may move the retaining portion 19 of the tension rail 20 outwardly towards the interior walls 22 of the basket 14 of the separator 10 to apply tension to the screen 105. The retaining portion 19 of the tension rail 20 may also move the rod 115 outwardly towards the interior walls 22 of the separator 10 to apply tension to the screen 105.

The screen rod tensioning system 100 may also eliminate the need for sectional screens in the separator 10. Some installations may not have adequate space around the separator 10 to install a full twelve foot screen, for example. For such installations, the use of sectional screens may be required. Typically, the sectional screens may be smaller sized screens installed adjacent to each other in the separator 10 to fill the basket 14 of the separator 10. However, sectional screens may be cumbersome and may create additional opportunities for bypass of the slurry.

As shown in FIGS. 12 and 13, the screen rod tensioning system 100 may reduce and/or eliminate the bypass opportunities by using shorter rods butted together. For example, the rod 115 of the screen rod tensioning system 100 may be segmented. For example, the screen rod tensioning system 100 may use two six foot rods arranged end-to-end instead of one twelve foot rod 115. Due to limited space adjacent to the separator 10, the profile 110 of the screen 105 may be guided into the channel 120 of the first six foot rod. Subsequently, the profile 110 of the screen 105 may be guided into the second six foot rod. In this manner, the full twelve foot length of the screen 105 may be installed in the separator 10. Further, the bypass opportunities may be reduced and/or eliminated by using a full length screen of the screen rod tensioning system 100. Further, the length of the rod 115 may vary based upon the particular requirements and/or applications of the user.

In other embodiments, the screen rod tensioning system 100 may use different length rods arranged end-to-end on a common axis instead of one twelve foot rod 115. As shown in FIGS. 12 and 13, for example, the screen rod tensioning system 100 may use three four foot rods 116 arranged end-to-end on the common axis instead of one twelve foot rod 115. In an embodiment, the screen rod tensioning system 100 may use four three foot rods arranged end-to-end instead of one twelve foot rod 115. The three four foot rods 116 arranged end-to-end on the common axis and/or the four three foot rods arranged end-to-end on the common axis may enable the screen 105 to be installed in the separator 10 in a simplified manner. For example, the three four foot rods 116 arranged end-to-end on the common axis may permit the screen to be inserted into the separator 10 one four foot segment at a time.

Further, the screen rod tensioning system 100 may allow replacement of the screen 105 in a simple manner. During use of the screen 105 in industrial filtration systems, the screen 105 may become damaged. For example, the screen 105 may be used in the separator 10 to separate drill cuttings from drilling fluid in on-shore and/or off-shore oilfield drilling. Such a harsh environment may be destructive to the screen 105 over a period of extended use and/or from repeated exposure to the drill cuttings. Periodic inspections of the screen 105 may indicate that damage may have occurred to the screen 105. The user may remove the screen 105 for replacement with a new screen 105. In an embodiment, the three four foot rods arranged end-to-end may be removed from the separator 10 one four foot segment at a time. The screen 105 may be folded at the end of each four foot rod as each four foot rod is removed from the separator 10 to form four foot folded sections of the screen 105. As shown in FIG. 12, the screen 105 may be rolled following the removal of the profile 110 and the first four foot rod from the separator 10. Thus, using the four foot rods with the screen 105 may require less effort to remove the screen 105 from the separator 10. Removal in such a manner may also be performed in a smaller area around the separator 10. A replacement screen may subsequently be reinstalled into the separator 10.

Figure 5:
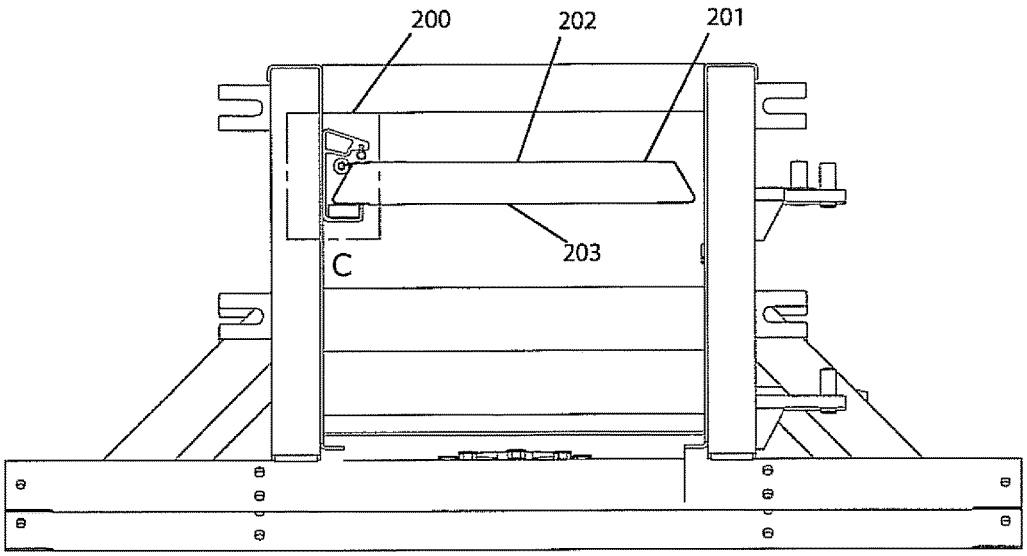
FIG. 5 illustrates an elevation view of a vibratory screen apparatus having a screen rod tensioning system with an airbag in a loosened position in accordance with embodiments disclosed herein.
Figure 6:
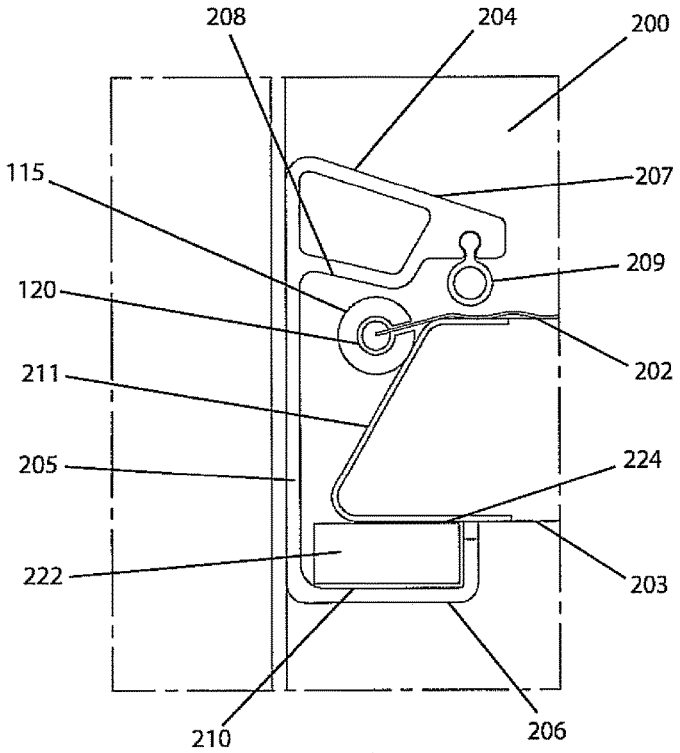
FIG. 6 illustrates a detail view of the screen rod tensioning system with the airbag within box "C" of FIG. 5.

FIG. 5 illustrates another embodiment of a screen rod tensioning system 200 in the separator 10. FIG. 6 illustrates an enlarged detail view of a portion within box "C" of the screen rod tensioning system 200 of FIG. 5. For simplicity, FIG. 5 illustrates a left side connection for the screen rod tensioning system 200. However, the right side connection may be provided in the same manner. Further, a single deck is shown in FIG. 5. However, the separator 10 may have multiple decks.

As shown in FIG. 5, a ball box 201 may be located in the basket 14 of the separator 10. The ball box 201 may have a top surface 202 and a bottom surface 203. The top surface 202 of the ball box 201 and the bottom surface 203 of the ball box 201 may be arranged approximately parallel to each other. Further, each end of the ball box 201 may have an angled end 211. The ball box 201 may be supported and/or held within the basket 14 by a ball box rail 204.

As shown in enlarged detail in FIG. 6, the ball box rail 204 may have a vertical portion 205 arranged between a lower portion 206 and an upper portion 207. The lower portion 206 may have a channel 210 formed along the length of the ball box rail 204. The upper portion 207 of the ball box rail 204 may have an angled interior surface 208. The upper portion 207 may also have a seal 209. The seal 209 may be a bubble gasket, a P-gasket and/or the like. The seal 209 may be formed of a flexible sealing material and may be deformable.

Figure 7:
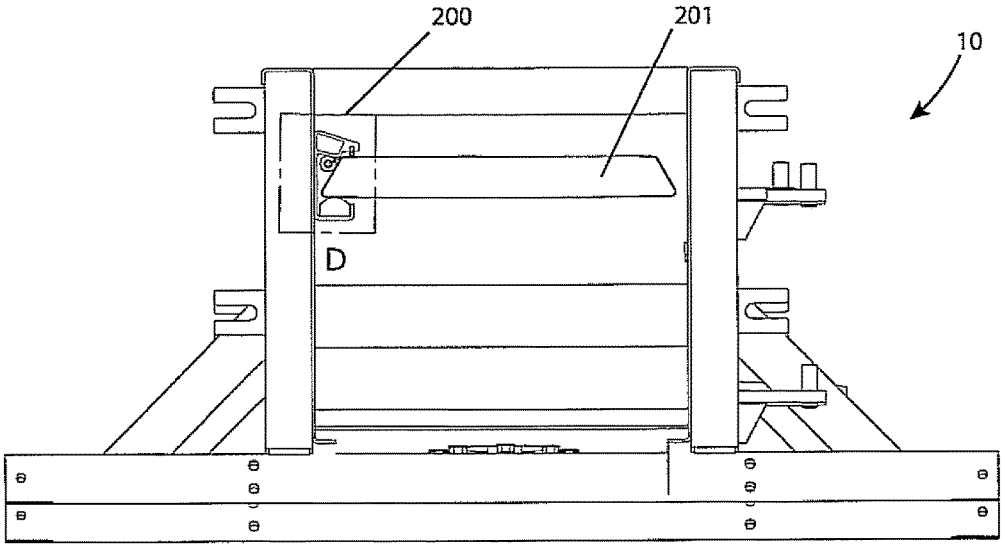
FIG. 7 illustrates an elevation view of a vibratory screen apparatus having a screen rod tensioning system with an airbag in a tightened position in accordance with embodiments disclosed herein.
Figure 8:
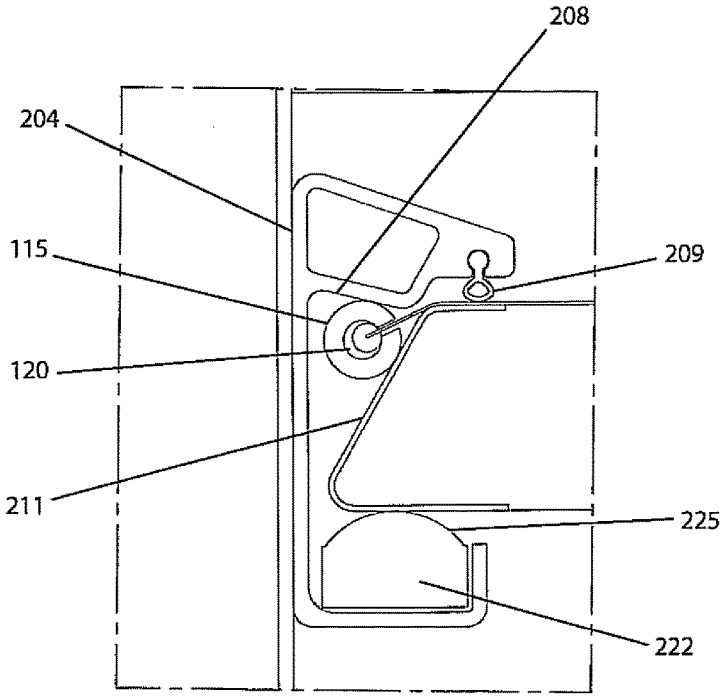
FIG. 8 illustrates a detail view of the screen rod tensioning system with the airbag within box "D" of FIG. 7.

The screen rod tensioning system 200 may have an airbag 222 located in the channel 210. The airbag 222 may be formed of a flexible material. The airbag 222 may have a generally rectangular shape in cross-section. The airbag 222 may have a top portion 224. The top portion 224 may be relatively flat as shown in FIGS. 5 and 6. The airbag 222 may be pneumatically or hydraulically inflated. After inflation of the airbag 222, the top portion 224 of the airbag 222 may have an arcuate shape 225 in cross-section as shown in FIGS. 7 and 8. The top portion 224 may increase the height of the airbag 222.

In the embodiment shown in FIGS. 5 and 6, the airbag 222 may be uninflated. FIGS. 7 and 8 illustrate the airbag 222 in an inflated state. The operation of the screen rod tensioning system 200 may be described with reference to FIGS. 5-8. Referring specifically to the enlarged detail shown in FIGS. 6 and 8, the airbag 222 may be inflated to provide tension to the surface of the screen 105. As shown in FIG. 6, the screen 105 may be located on the top surface 202 of the ball box 201. The screen 105 may be in a relatively loosened position. The bottom surface 203 of the ball box 201 may be located on the airbag 222 that may be mounted within the channel 210 of the lower portion 206 of the ball box rail 204.

The profile 110 of the screen 105 may be inserted within the channel 120 of the rod 115. The rod 115 may be located on the angled end 211 of the ball box 201. The rod 115 may be located below the angled interior surface 208 of the upper portion 207 of the ball box rail 204 without being in contact therewith. Also, the screen 105 may be located below the seal 209 on the upper portion 207 of the ball box rail 204 without being in contact therewith. The seal 209 may have a circular cross-section.

As shown in FIG. 8, the airbag 222 may be inflated which may contact the bottom surface 203 of the ball box 201 to lift the ball box 201 upwards. As the ball box 201 may be raised upwards, the rod 115 may contact the angled interior surface 208 of the upper portion 207 of the ball box rail 204. The rod 115 may also contact the angled end 211 of the ball box 201. The upward pressure on the ball box 201 combined with the contact of the rod 115 with both the angled interior surface 208 of the upper portion 207 of the ball box rail 204 and the angled end 211 of the ball box 201 may urge the rod 115 in an outwardly and/or downwardly direction. The inflation of the airbag 222 on the right hand side of the ball box 201 may operate in the same manner. As a result, the forces on the rod 115 at each end of the ball box 201 may place the screen under tension and tighten the screen 105 against the top surface 202 of the ball box 201.

As shown in FIG. 8, the seal 209 may contact the screen 105 on the top surface 202 of the ball box 201. The seal 209 may be compressed against the screen 105 to form a seal for the screen 105. The rod 115 may be forced into contact with the angled interior surface 208 of the upper portion 207 of the ball box rail 204 and the angled end 211 of the ball box 201 to create a secondary seal for the screen 105.

Figure 9:
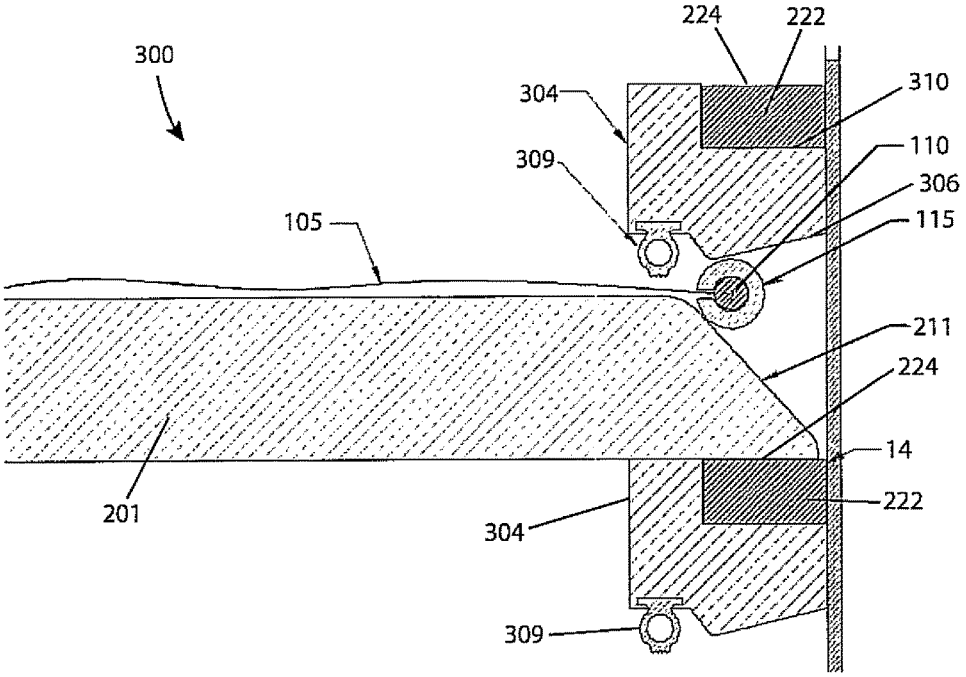
FIG. 9 illustrates a side view of another embodiment of the screen rod tensioning system with an airbag in a loosened position as disclosed herein.
Figure 10:
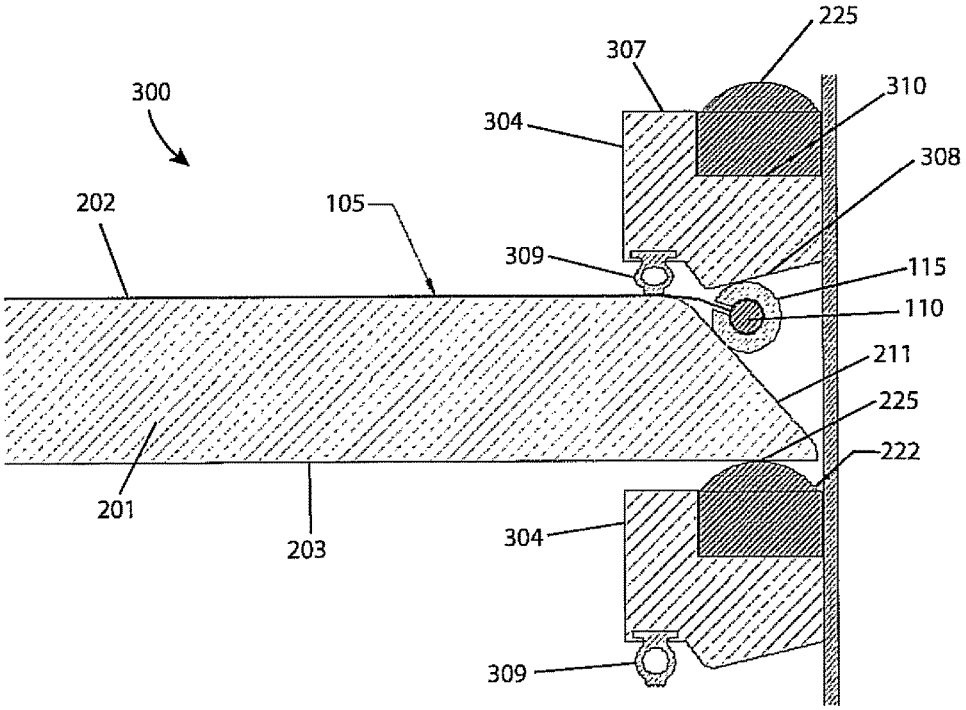
FIG. 10 illustrates a side view of another embodiment of the screen rod tensioning system with an airbag in a tightened position as disclosed herein.

FIGS. 9 and 10 illustrate an embodiment of another screen rod tensioning system 300 in the separator 10. FIG. 9 illustrates a side view of the screen rod tensioning system 300 in a loosened position as disclosed herein. FIG. 10 illustrates the screen rod tensioning system 300 in a tightened position as disclosed herein. FIGS. 9 and 10 illustrate a right side connection for the screen rod tensioning system 300. However, the left side connection may be provided in the same manner. Further, a single deck is shown in FIGS. 9 and 10. However, the separator 10 may have multiple decks.

As shown in FIGS. 9 and 10, wherein like numerals represent like parts, the ball box 201 may be located in the basket 14 of the separator 10. The ball box 201 may have the top surface 202 and the bottom surface 203. The top surface 202 of the ball box 201 and the bottom surface 203 of the ball box 201 may be arranged approximately parallel to each other. Further, each end of the ball box 201 may have the angled end 211. The ball box 201 may be supported and/or held within the basket 14 by a ball box rail 304. As shown in FIGS. 9 and 10, the screen rod tensioning system 300 may have multiple ball box rails 304 arranged above each other within the basket 14 of the separator 10.

As shown in FIG. 9, the ball box rail 304 may have a lower portion 306 and an upper portion 307. The upper portion 307 may have a channel 310 that may be formed along the length of the ball box rail 304. The lower portion 306 of the ball box rail 304 may have an angled surface 308. The lower portion 306 may also have a seal 309. The seal 309 may be a bubble gasket, a P-gasket and/or the like. The seal 309 may be formed of a flexible sealing material and may be deformable.

The screen rod tensioning system 300 may have the airbag 222 located in the channel 310. The airbag 222 may be made from a flexible material. The airbag 222 may have a generally rectangular shape in cross-section. The airbag 222 may have the top portion 224. The top portion 224 may be relatively flat as shown in FIG. 9. The airbag 222 may be pneumatically or hydraulically inflated. After inflation of the airbag 222, the top portion 224 of the airbag 222 may have the arcuate shape 225 in cross-section as shown in FIG. 10. The top portion 224 may increase the height of the airbag 222.

In the embodiment shown in FIG. 9, the airbag 222 may be uninflated. FIG. 10 illustrates the airbag 222 in an inflated state. The operation of the screen rod tensioning system 300 may be described with reference to FIGS. 9 and 10. The airbag 222 may be inflated to provide tension to the surface of the screen 105. As shown in FIG. 9, the screen 105 may be located on the top surface 202 of the ball box 201. The screen 105 may be in a relatively loosened position. The bottom surface 203 of the ball box 201 may be located on the airbag 222 that may be mounted within the channel 310 of the upper portion 307 of the ball box rail 304.

The profile 110 of the screen 105 may be inserted within the channel 120 of the rod 115. The rod 115 may be located on the angled end 211 of the ball box 201. The rod 115 may be located below the angled surface 308 of the lower portion 306 of the ball box rail 304. Also, the screen 105 may be located below the seal 309 on the lower portion 306 of the ball box rail 304 without being in contact therewith. The seal 309 may have a circular cross-section.

As shown in FIG. 10, the airbag 222 may be inflated which may contact the bottom surface 203 of the ball box 201 to lift the ball box 201 upwards. As the ball box 201 may be raised upwards, the rod 115 may contact the angled surface 308 of the lower portion 306 of the ball box rail 304. The rod 115 may also contact the angled end 211 of the ball box 201. The upward pressure on the ball box 201 combined with the contact of the rod 115 with both the angled surface 308 of the lower portion 306 of the ball box rail 304 and the angled end 211 of the ball box 201 may urge the rod 115 in an outwardly and/or downwardly direction. The inflation of the airbag 222 on the left hand side of the ball box 201 may operate in the same manner. As a result, the forces on the rod 115 at each end of the ball box 201 may place the screen under tension and tighten the screen 105 against the top surface 202 of the ball box 201.

As shown in FIG. 10, the seal 309 may contact the screen 105 on the top surface 202 of the ball box 201. The seal 309 may be compressed against the screen 105 to form a seal for the screen 105. The rod 115 may be forced into contact with the angled surface 308 of the lower portion 306 of the ball box rail 304 and the angled end 211 of the ball box 201 to create a secondary seal for the screen 105. Thus, the screen rod tensioning system 300 may use multiple ball box rails 304 to support multiple decks each having the screen 105 in tension over the top surface 202 of the ball box 201.

Figure 11:
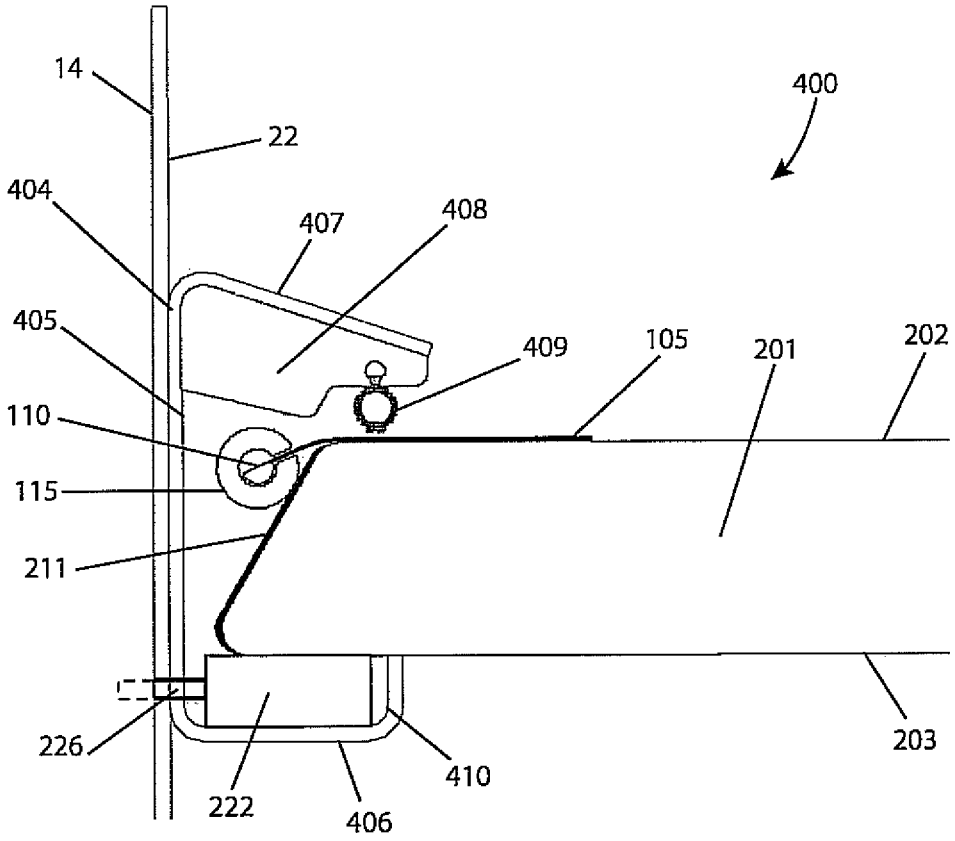
FIG. 11 illustrates a side view of another embodiment of the screen rod tensioning system with an airbag as disclosed herein.

FIG. 11 illustrates an embodiment of yet another screen rod tensioning system 400 in the separator 10. FIG. 11 illustrates a side view of the screen rod tensioning system 400 as disclosed herein. FIG. 11 illustrates a left side connection for the screen rod tensioning system 400. However, the right side connection may be provided in the same manner. Further, a single deck is shown in FIG. 11. However, the separator 10 may have multiple decks.

As shown in FIG. 11, wherein like numerals reference like parts, the ball box 201 may be located in the basket 14 of the separator 10. The ball box 201 may have the top surface 202 and the bottom surface 203. The top surface 202 of the ball box 201 and the bottom surface 203 of the ball box 201 may be arranged approximately parallel to each other. Further, each end of the ball box 201 may have the angled end 211. The ball box 201 may be supported and/or held within the basket 14 by a ball box rail 404.

As shown in FIG. 11, the ball box rail 404 may have a vertical portion 405 that may be arranged between a lower portion 406 and an upper portion 407. The lower portion 406 may have a channel 410 that may be formed along the length of the ball box rail 404. The upper portion 407 of the ball box rail 404 may have an angled insert 408. The angled insert 408 may be formed of a ultrahigh molecular weight ("UHMW") material, for example. However, other materials may be used, as desired. The upper portion 407 may also have a seal 409. The seal 409 may be a bubble gasket, a P-gasket and/or the like. The seal 409 may be made from a flexible sealing material and may be deformable.

The airbag 222 may be located in the channel 410 in the screen rod tensioning system 400. The airbag 222 may be made from a flexible material. The airbag 222 may have a generally rectangular shape in cross-section. The airbag 222 may have the top portion 224. The top portion 224 may be relatively flat as shown in FIG. 11. The airbag 222 may be pneumatically or hydraulically inflated. After inflation of the airbag 222, the top portion 224 of the airbag 222 may have the arcuate shape 225 in cross-section as shown in FIGS. 7, 8 and 10. The top portion 224 may increase the height of the airbag 222.

In the embodiment shown in FIG. 11, the airbag 222 may be uninflated. The airbag 222 may be filled pneumatically or hydraulically using a port 226 shown in FIG. 11. FIGS. 7, 8 and 10 illustrate the airbag 222 in an inflated state. The operation of the screen rod tensioning system 400 may be described with reference to FIG. 11. The airbag 222 may be inflated to provide tension to the surface of the screen 105. As shown in FIG. 11, the screen 105 may be located on the top surface 202 of the ball box 201. The bottom surface 203 of the ball box 201 may be located on the airbag 222 that may be mounted within the channel 410 of the lower portion 406 of the ball box rail 404.

The profile 110 of the screen 105 may be inserted within the channel 120 of the rod 115. The rod 115 may be located on the angled end 211 of the ball box 201. The rod 115 may be located below the angled insert 408 of the upper portion 407 of the ball box rail 404 without being in contact therewith. Also, the screen 105 may be located below the seal 409 on the upper portion 407 of the ball box rail 404 without being in contact therewith. The seal 409 may have a circular cross-section.

As shown in FIGS. 7, 8 and 10, the airbag 222 may be inflated which may contact the bottom surface 203 of the ball box 201 to lift the ball box 201 upwards. As the ball box 201 may be raised upwards, the rod 115 may contact the angled insert 408 of the upper portion 407 of the ball box rail 404. The rod 115 may also contact the angled end 211 of the ball box 201. The upward pressure on the ball box 201 combined with the contact of the rod 115 with both the angled insert 408 of the upper portion 407 of the ball box rail 404 and the angled end 403 of the ball box 201 may urge the rod 115 in an outwardly and/or downwardly direction. The inflation of the airbag 222 on the right hand side of the ball box 201 may operate in the same manner. As a result, the forces on the rod 115 at each end of the ball box 201 may place the screen under tension and tighten the screen 105 against the top surface 202 of the ball box 201.

After the airbag 222 may be inflated, the seal 409 may contact the screen 105 on the top surface 202 of the ball box 201. The seal 409 may be compressed against the screen 105 to form a seal for the screen 105. The rod 115 may may be forced into contact with the angled insert 408 of the upper portion 407 of the ball box rail 404 and the angled end 211 of the ball box 201 to create a secondary seal for the screen 105.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the present disclosure should be limited only by the attached claims.

The invention claimed is:

1. A system comprising:

a screen having a length defined between a first end and a second end, the screen having a profile along the length of the screen;

a first rod having a channel configured to receive the profile of the screen therein, the first rod having a plurality of segmented portions such that a first segmented portion of the plurality of segmented portions is separable from a second segmented portion of the plurality of segmented portions;

a frame having a first surface configured for positioning the screen thereon; and a clamping mechanism located adjacent to at least one selected from the first rod and the frame, wherein the clamp mechanism is configured for tensioning the screen with respect to the frame.

2. The system of claim 1, wherein the first rod has a circular cross-section.

3. The system of claim 1, wherein the channel has a circular cross-section.

4. The system of claim 1, wherein the profile on the screen has a circular cross-section.

5. The system of claim 1, wherein the first rod has a polygonal cross-section.

6. The system of claim 1, wherein the plurality of segmented portions are arranged coaxially along the length of the screen.

7. The system of claim 1, wherein the profile extends the length of the screen along a first side of the screen and a second side of the screen.

8. The system of claim 1, wherein the profile is configured to insert into the channel of the first rod.

9. The system of claim 1, wherein the profile is configured to withdraw from the channel of the first rod.

10. The system of claim 1, wherein the first rod has a non-circular cross-section.

11. A method comprising:

providing the system according to claim 1, wherein the profile of the screen extends along the length of a first side and a second side of the screen;

inserting the profile of the first side into the channel of the first rod;

inserting the profile of the second side into a channel of a second rod;

positioning the screen on the frame having a first side and a second side;

positioning the first rod adjacent to the first side of the frame and the second rod adjacent to the second side of the frame; and moving the first rod and the second rod such that the profile rotates with respect to the rod to tension the screen.

12. The method of claim 11 further comprising:

applying the clamping force to the rod wherein the profile engages the rod such that the clamping force on the rod moves the profile to tension the screen.

13. The method of claim 11 further comprising:

inserting the profile of the first side into a channel of a third rod positioned on a common axis as the first rod and inserting the profile of the second side into a channel of a fourth rod positioned on a common axis as the second rod.

14. The method of claim 11 further comprising:

adjusting inflation of an airbag on the frame to urge the rod against the frame such that the rod moves the profile to adjust tension on the screen.

15. The method of claim 11 further comprising:

inserting the profile into a plurality of rods arranged on a common axis along the length of the first side and the second side.

16. The method of claim 11 further comprising:

removing the profile of the first side from the channel of the first rod and removing the profile of the second side from the channel of the second rod to permit removal of a portion of the screen from the frame.

17. The method of claim 11 further comprising:

folding a portion of the screen along an axis perpendicular to the common axis of the first rod during removal from the frame.

18. The method of claim 11 further comprising:

bending a portion of the screen when positioning the screen on the frame.

19. The method of claim 11 further comprising:

removing the profile from one of a plurality of rods arranged on a common axis along the length of the first side and the second side simultaneously.

20. The method of claim 11 further comprising:

rotating the first rod and the second rod in opposite directions to tension the screen.

* * * * *